United States Patent [19]

Asdollahi et al.

[11] Patent Number: 4,899,123

[45] Date of Patent: Feb. 6, 1990

[54] HIGH CURRENT CAPACITY SUB-MINIATURE FUSE

[75] Inventors: Norbert Asdollahi, Witten; Karl Poerschke, Sprockhövel; Klaus Stärk, Witten; Claus Friedrich, Gevelsberg, all of Fed. Rep. of Germany

[73] Assignee: Wickmann-Werke GmbH, Witten, Fed. Rep. of Germany

[21] Appl. No.: 284,498

[22] Filed: Dec. 15, 1988

[30] Foreign Application Priority Data

Dec. 16, 1987 [DE] Fed. Rep. of Germany ..... 3742532
Sep. 26, 1988 [DE] Fed. Rep. of Germany ..... 8812144

[51] Int. Cl.[4] ..... H01H 85/38
[52] U.S. Cl. ..... 337/273; 337/199
[58] Field of Search ..... 337/273, 280, 282, 199, 337/186

[56] References Cited

U.S. PATENT DOCUMENTS 3,110,787 11/1963 Borzoni ..... 337/273
4,417,226 11/1983 Asdollahi et al. ..... 337/273

*Primary Examiner*—H. Broome
*Attorney, Agent, or Firm*—Banner, Birch, McKie & Beckett

[57] ABSTRACT

A sub-miniature fuse having a fusible conductor which will fuse under an over-current condition within a pressure-tight chamber. A metal surface is positioned near the fusible conductor within the chamber and is formed and positioned relative to the fusible conductor so that during the switching off of the fuse, any arc created between the fused ends jumps over to the metal surface. Thus, at least one secondary arc is created which burns against the metal surface as a shunt line. By melting a part of the metal surface, sufficient heat is absorbed that the secondary arc is quenched.

19 Claims, 2 Drawing Sheets

HIGH CURRENT CAPACITY SUB-MINIATURE FUSE

BACKGROUND OF THE INVENTION

The present invention relates to the field of fuses and fuse structures. More particularly, the invention is directed to a sub-miniature fuse having a high current capacity.

Miniature and sub-miniature fuses are very popular due to the small space they occupy. A conventional sub-miniature fuse has a cylindrical housing of approximately 6 mm in height and approximately 8 mm in outer diameter. The switching, or fusing, capacity of these fuses is usually on the order of 35 amps under 250 volts or 100 amps under 125 volts. In numerous applications, an even higher switching capacity is necessary. Thus, early arc quenching within the fuse is required. An arc is created after the melting of the fusible conductor has started and allows the current to continue to flow in spite of the separation of the fusible conductor or wire in response to an over-current condition. Due to the continued arcing, the pressure and temperature within the fuse housing will rise because of the continued addition of energy. The buildup in pressure may continue until the maximum load pressure of the fuse is exceeded and the fuse housing is destroyed. Thus, the fuse explodes. In order to prevent such a marked rise in pressure and temperature within the fuse housing, the fuse chamber is filled with an energy-absorbing mass. For instance, a metal is used as an energy-absorbing mass in German Pat. No. 724,865. Other attempts in the prior art have been made to relieve the critical buildup of pressure in a fuse by using a metal cap which is soldered or welded onto a base of ceramic material. Fuses of this type are disclosed in German utility model No. 85 07 615.5.

The prior art attempts to overcome the pressure buildup in fuses have lead to no significant improvement or reduction of the problem. Thus, conventional fuses remain deficient in this regard.

SUMMARY OF THE INVENTION

Accordingly, it is therefore, the primary object of the present invention to provide a fuse structure which overcomes the pressure buildup problem noted in conventional fuses and allows for much higher current capacity.

It is a specific object of the present invention to provide a sub-miniature fuse which has higher current switching capacity than such fuses known in the prior art.

It is another specific object of the present invention to provide a sub-miniature fuse which has a higher current switching capacity than known in the prior art and which is not substantially larger in physical size than fuses known in the prior art.

It is a further specific object of the present invention to provide a sub-miniature fuse having the above-noted advantages which is low in cost and easy to manufacture.

The above and other objects of the present invention are achieved by a sub-miniature fuse which has a sealed pressure-tight, gas-filled, or evacuated, chamber. The chamber is formed of a plastic base, a cap, two contacts which traverse the base in a gas-tight manner, a fusible conductor which melts under an over-current condition and a metal surface within the chamber which serves to receive heat during the quenching of an arc after the fusible conductor is melted away.

The metal surface is formed and positioned relative to the fusible conductor and contacts such that an arc which is generated between the melting ends of a separated fusible conductor jumps over to the metal surface and is thus quenched.

Tests have shown that the features proposed by the present invention allow a substantial increase in the switching capacity of sub-miniature fuses without changing the outer dimensions. Contrary to prior art sub-miniature fuses, the energy freed during the melting of the fusible conductor within the chamber of the fuse is neutralized within the space defined by the chamber without using a gaseous medium in the chamber for energy transport or absorption. It is the use of such a medium surrounding the fusible conductor for transmitting the heat onto a metal surface which has proved to be too slow in prior art fuses so that the danger of an explosion could not be controlled under high switching currents.

The present invention teaches the use of a metal surface for directly breaking up the arc and directing the arc to cold sections of the fuse which have a high heat dissipation capacity. This cools the environment of the arc sufficiently that the arc is extinguished. A substantial part of the added energy which otherwise causes heating of the gas within the chamber of prior art fuses, and thus the unwanted rising of the inner pressure, is used in the present invention for melting a metal so that the maximum load pressure of the fuse housing is not reached. In other words, the metal surface, when correctly designed and positioned, serves to cool down the arc and extract energy which is directly transferred to the metal surface. From the time the arc jumps onto the metal surface and forms a shunt-line, the metal will melt. Therefore, it is very important that the thickness of the metal surface to be sufficiently dimensioned so that it does not melt through and that no holes occur through which the generated metal vapour and gases may be blown out of the chamber.

The energy loss by separating, diverting and using the arc to melt metal is so effective that the pressure within the chamber is surprisingly low during the over-current induced switching off of the fuse. This is true even when the over-current condition reaches levels which known miniature and sub-miniatures fuses cannot handle.

The present invention can be practiced independently from the respective housing shape and configuration of all known miniature and sub-miniature fuses. In each case, it is important that the arc jumps over to the metal surface from the fusible wire in time and thus a sufficient part of the energy is transformed into melting capacity and stored within the material of the metal surface. In this way, the internal pressure within the chamber is kept very low. Jumping over of the arc in time means that the fusible conductor must have been melted away to a minimum length before the arc transgresses to the metal surface so that there is a sufficient gap of separation when all arcs are quenched. However, jumping over of the arc in one or two paths against the metal surface must not occur too late. Otherwise, direct heating of the metal surface and storing of energy as early as possible will not be accomplished.

Prior art fuses which use a metal cap are unable to function in accordance with the present invention. Such metal caps were always positioned so that the created arc had no possibility during the melting of the fusible conductor to jump onto the metal cap. Metal caps have been used in the prior art because of their ability to be soldered and due to their high strength. They have not been used for their melting and heat dissipation capacity for quenching an arc.

By choosing the proper distance between the fusible wire and contacts relatively to the metal surface, an area can be selected to which the arc will jump after melting of the fusible wire. Under the restricted conditions which normally prevail within a sub-miniature fuse, the distances between the fusible wire and contacts and the metal surface is so chosen that two arcs exist after the transgression at two places which have the greatest distance to each other within the chamber.

There also are advantages obtained by providing a direct contact between one of the contacts and the metal surface so that a current flows, not only by jumping over of an arc, but also from the outset. The other contact is then positioned such that the distance to the metal surface is smaller than the smallest distance between the fusible wire and the metal surface at any other location. In this way, control of the arc is extremely predictable and is completely independent of the position of the whole fuse.

BRIEF DESCRIPTION OF THE DRAWINGS

Hereinafter, preferred embodiments of the invention are described in greater detail in reference to the drawing in which.

DETAILED DESCRIPTION OF THE PREFERRED EMBODIMENT

Figure 1:
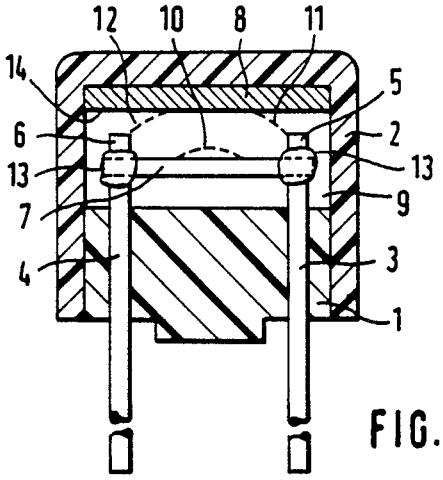
FIG. 1 is a cross-sectional view through a sub-miniature fuse according to the present invention in which the metal surface is formed of a disc.

FIG. 1 illustrates a sub-miniature fuse according to the present invention which comprises a cylindrical base 1 is made of plastic material. Cap 2 of a like material is connected with base 1 in a pressure proof manner, for instance by welding onto the base. Two contacts 3 and 4 penetrate base 1, the contacts having a circular cross-sectional shape and being gas-tightly mounted within base 1. Their end sections 5 and 6 carry a fusible conductor 7 which is fixed to end sections 5 and 6 of contacts 3 and 4 in a conventional manner, for example by solder 13, by welding or by bonding. Base 1 and cap 2 form a pressure-tight cylindrical chamber 9 in which fusible conductor 7 is surrounded by a gaseous medium. The dimensions of the illustrated sub-miniature fuse are very small, the diameter being approximately 10 mm and the height being approximately 8 mm.

On top of fusible conductor 7, and end sections 5 and 6 of contacts 3 and 4, circular metal disc 8 is positioned. The metal used to form disc 8 may be selected from among iron, copper, aluminum, titanium, tin, zinc, molybdenum, tungsten, silver, nickel or tantalum or an alloy comprising at least one of these elements. Disc 8 is inserted into position before the assembly of cap 2 by pressing in, glueing in or a similar technique. Disc 8 has a metal surface 14 which faces the fusible conductor 7 and which is part of the separating process when the fuse switches off during an over-current condition.

In an over-current condition, fusible conductor 7 melts and a primary arc 10 is created which is indicated in FIG. 1 in dotted lines. When the separating gap between the ends of fusible conductor 7 has reached approximately the distance of end portions 5 and 6 of contacts 3 and 4, the arc jumps onto metal disc 8 and two secondary part-arcs 11 and 12 are created, each arc burning between one of the end sections 5 and 6 and metal surface 14 as a shunt line. Primary arc 10 is thus quenched. The secondary part-arcs 11 and 12 also are quickly quenches so that the internal pressure within chamber 9 hardly rises.

Practical tests with disc 8 made of Fe and having a thickness of 1 mm have shown a switching current capacity of 100 A under 250 V when a fusible conductor 7 was used having a slow response characteristic.

Figure 2:
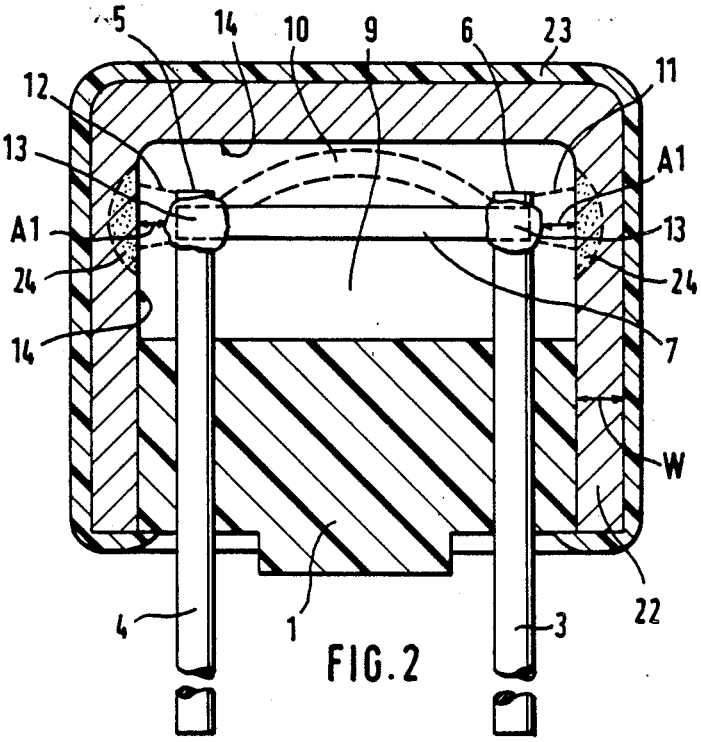
FIG. 2 is a cross-sectional view through a sub-miniature fuse according to the present invention in which the metal surface comprises a metal cap.
Figure 3:
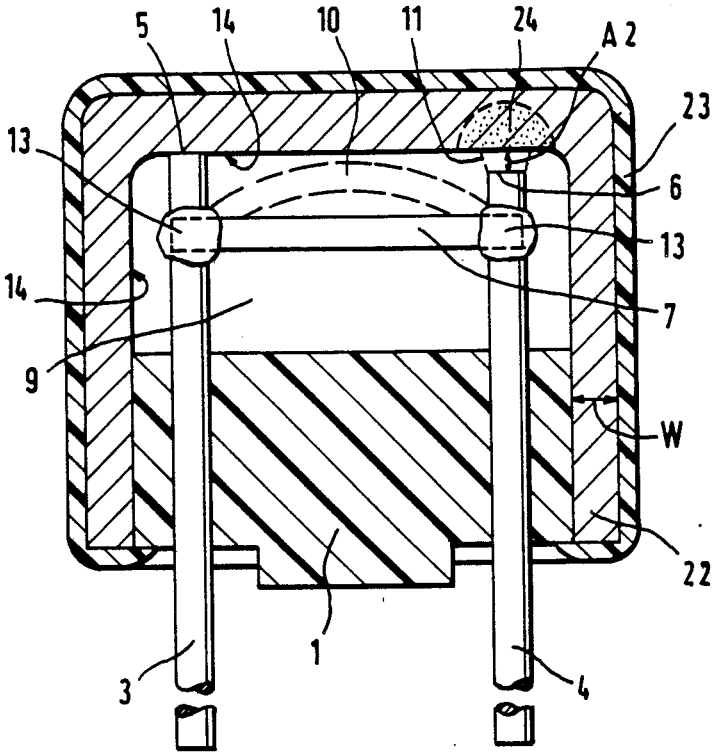
FIG. 3 is a cross-sectional view through a sub-miniature fuse according to the present invention which is similar to the embodiment shown in FIG. 2 and in which one of the contacts is in physical contact with the metal cap.

Other embodiments of the invention are shown in FIGS. 2 and 3. Parts identical to those in FIG. 1 have the same reference number. The main difference between these embodiments and the embodiment shown in FIG. 1 is that instead of a disc 8 according to the embodiment shown in FIG. 1, a metal cap 22 is provided. The function of cap 22 is explained hereinafter.

Metal cap 22 has an isolating layer on the outside in the shape of a plastic cap 23. Also, an electrically isolating plastic layer may be used which may be positioned onto the metal before forming metal cap 22 out of a flat piece of tin. Of course, the isolating layer also may be applied at the end of the manufacture of the fuse by dip coating cap 22 into a liquid bath of plastic or by spraying a corresponding layer onto the surface of metal cap 22.

The embodiment shown in FIG. 2 has a distance A 1 between fusible conductor 7, contacts 3 and 4 and/or solder 13 on the one hand and the adjacent metal surface 14 of metal cap 22 on the other hand. This gap is smaller than the distance between these components at any other area along metal surface 14 of metal cap 22, for example as compared to the bottom surface of metal cap 22. The wall thickness W of metal cap 22 corresponds to the energy load which is expected during the switching off of the fuse in an over-current condition. Therefore, there must be a certain minimal thickness.

In an over-current condition, fusible conductor 7 melts and there will be a primary arc 10 which is shown again by dotted lines in FIG. 2. The distance A 1 between contacts 3 and 4 respectively fusible conductor 7 and metal surface 14 is so chosen that primary arc 10 jumps, when the fusible conductor is melted down to create a sufficiently long gap, from contacts 3 and 4 to adjacent sections 24 of the metal surface 14 along two paths so that two secondary arcs 11 and 12 exist. These secondary arcs 11 and 12 are again shown in FIG. 2 by dotted lines. Sections 24, which are one origin of secondary arcs 11 and 12, melt. Thus, the arc energy is extracted from the two secondary arc 11 and 12 until they are quenched.

Especially in fuses with a high switching-off capacity, arcs are created with burn relatively deep caves into sections 24 of metal cap 22 so that sufficient dimensioning of wall thickness W is absolutely necessary in correspondence to the switching loads to be expected.

In the embodiment shown in FIG. 3, contact 3 extends up to metal surface 14 with its end section 5.

There is a distance A 2 between the other end section of contact 4 and metal surface 14 of metal cap 22 which is smaller than the lateral distance of contact 4, as well as fusible conductor 7, from the laterally positioned metal surface 14 in the cylindrical section of metal cap 22. This arrangement is chosen in order to ensure that the diagrammatically shown secondary arc 12 jumps from the end section 6 of the contact 4 onto the frontal metal surface 14 of metal cap 22 when fusible conductor 7 is sufficiently gapped during an over-current condition. Section 24 is highly heated and will partially melt, whereby energy is extracted from secondary arc 12 until it is extinguished.

The embodiment illustrated in FIG. 3 is especially suitable for controlling the secondary arc so that this type of fuse is especially independent of the total positioning of the elements within the fuse. Of course, end section 5 of contact 3 may also be positioned by a distance A 2 compared to metal surface 14 of metal cap 22 so that in case of an over-current condition, there are two secondary arcs.

Table 1 below shows dimensions for various elements in the fuse structure shown in FIG. 2. Such dimensions provide a sufficient wall thickness W and distance A 1. The invention is, of course, not limited to the dimensions shown in Table 1.

TABLE 1

| | |
|---|---|
| Outer diameter of metal cap | 7.8 to 7.9 mm |
| Wall thickness of metal cap | 0.5 mm |
| Diameter of contacts 3 and 4 | 0.6 mm |
| Distance between contacts 3 and 4 | 5.0 mm |
| Length of chamber 9 | 3.2 mm |
| Lateral distance A 1 of contacts 3 and 4 | 0.5 mm |
| Maximum switching capacity | 200 A |
| Characteristics of the fuse | very quick, quick, slow, very slow |

It will be appreciated by those skilled in the art that many changes may be made to the illustrated embodiments without departing from the spirit and scope of the invention as set forth in the appended claims and that in some cases, certain features of the invention may be used to advantage without a corresponding use of other features.

We claim:

1. A fuse having a sealed chamber which is formed by a plastic base, a cap, two contacts which traverse said base, a fusible wire which melts under an over-current condition and a metal surface within said chamber for receiving heat during quenching of an arc which is generated after said fusible wire has been interrupted by fusing, the improvement comprising:

forming and positioning said metal surface relative to said fusible wire and said contacts in such a way that the arc jumps onto said metal surface and is thus quenched.

2. A fuse according to claim 1, wherein said metal surface is substantially formed by a disc.

3. A fuse according to claim 2, wherein said disc is positioned above said fusible wire.

4. A fuse according to claim 3, wherein said disc is positioned in a first plane which is parallel to a second plane, said second plane being defined by said fusible wire.

5. A fuse according to claim 3, wherein said disc has the form of a cross-section of said cap.

6. A fuse according to claim 1, wherein said metal surface covers substantially the entire inside of said cap.

7. A fuse according to claim 6, wherein said metal surface forms a lining of said cap which is made of plastic.

8. A fuse according to claim 6, wherein said metal surface is formed by a metal cap.

9. A fuse according to claim 8, wherein said meal cap is covered by an outer isolating layer.

10. A fuse according to claim 2, wherein said metal surface is formed from a material selected from the group consisting of iron, copper, aluminum, titanium, tin, zinc, molybdenum, tungsten, silver, nickel, tantalum or an alloy of at least one of said materials.

11. A fuse according to claim 1, wherein one of said contacts touches said metal surface and wherein the other contact is positioned at a distance from said metal surface which is smaller than distance between said fusible wire and said metal surface at any other location.

12. A fuse, said fuse comprising:

a chamber; said chamber being formed of a base, a cap, at least one contact which traverses said base, a fusible wire and a metal surface within said chamber, wherein said metal surface is adapted to receive heat for quenching any arc generated after said fusible wire has been fused in response to an over-current condition;

wherein said metal surface is formed and positioned relative to said fusible wire such that said arc is transferred to said metal surface for quenching.

13. A fuse according to claim 12, wherein said metal surface is substantially formed by a disc.

14. A fuse according to claim 13, wherein said disc is positioned above said fusible wire.

15. A fuse according to claim 14, wherein said disc is positioned in a first plane which is parallel to a second plane, said second plane being defined by said fusible wire.

16. A fuse according to claim 14, wherein said disc has the form of a cross-section of said cap.

17. A fuse according to claim 12, wherein said metal surface forms a lining of said cap which is made of plastic.

18. A fuse according to claim 12, wherein said metal surface is formed from a material selected from the group consisting or iron, copper, aluminum, titanium, tin, zinc, molybdenum, tungsten, silver, nickel, tantalum or an alloy of at least one of said materials.

19. A fuse according to claim 12, wherein a first said contact touches said metal surface and wherein a second contact is positioned at a distance from said metal surface which is smaller than the distance between said fusible wire and said metal surface at any other location.

* * * * *